US012038229B2

(12) United States Patent
Nuss

(10) Patent No.: US 12,038,229 B2
(45) Date of Patent: Jul. 16, 2024

(54) SYNCHRONIZED BASKET FLAP

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/952,020

(22) Filed: Sep. 23, 2022

(65) Prior Publication Data

US 2024/0102725 A1 Mar. 28, 2024

(51) Int. Cl.

| | |
|---|---|
| ***F25D 23/02*** | (2006.01) |
| ***F25D 25/02*** | (2006.01) |
| *A47B 88/00* | (2017.01) |

(52) U.S. Cl.

CPC ..... *F25D 25/025* (2013.01); *F25D 23/028* (2013.01); *F25D 2323/02* (2013.01)

(58) Field of Classification Search

CPC .. F25D 25/025; F25D 23/028; F25D 2323/02; F25D 23/021; F25D 23/02; F25D 23/025; A47B 2210/175; A47B 88/95; A47B 88/956; A47B 88/944; A47B 88/70

See application file for complete search history.

(56) References Cited

U.S. PATENT DOCUMENTS

| | | | | |
|---|---|---|---|---|
| 2,116,370 | A | 5/1938 | Watkins | |
| 2,132,737 | A | 10/1938 | Kahn | |
| 3,033,637 | A * | 5/1962 | Van Donk | B42F 17/14 220/558 |
| 4,149,518 | A | 4/1979 | Schmidt et al. | |
| 5,366,285 | A * | 11/1994 | Borgen | G07F 11/16 62/250 |
| 5,947,573 | A | 9/1999 | Tovar et al. | |
| 6,243,918 | B1 | 6/2001 | Zetti | |
| 7,467,834 | B2 | 12/2008 | Kim et al. | |
| 7,669,260 | B2 * | 3/2010 | Smith | A61G 13/06 5/604 |
| 7,731,314 | B2 | 6/2010 | Kim | |
| 7,815,268 | B2 | 10/2010 | Lee et al. | |
| 7,886,407 | B2 | 2/2011 | Resnik et al. | |
| 7,987,558 | B2 | 8/2011 | Beckmann et al. | |
| 8,186,781 | B2 | 5/2012 | Coleman et al. | |
| 8,231,190 | B2 | 7/2012 | Ertz et al. | |
| 8,459,759 | B2 | 6/2013 | Kang et al. | |
| 8,523,301 | B1 | 9/2013 | Britson | |
| 8,955,352 | B2 | 2/2015 | Lee et al. | |
| 9,635,771 | B2 | 4/2017 | Head | |
| 9,752,817 | B2 | 9/2017 | Richards et al. | |
| 10,119,219 | B2 | 11/2018 | Lee et al. | |
| 10,281,194 | B2 | 5/2019 | Choo et al. | |
| 10,362,870 | B1 | 7/2019 | Smith | |
| 10,443,271 | B1 | 10/2019 | Rose et al. | |

(Continued)

FOREIGN PATENT DOCUMENTS

| | | | |
|---|---|---|---|
| CN | 105972924 | A | 9/2016 |
| CN | 106705556 | A * | 5/2017 |

(Continued)

*Primary Examiner* — Kimberley S Wright
(74) *Attorney, Agent, or Firm* — Dority & Manning, P.A.

(57) ABSTRACT

A refrigerator appliance having a drawer with a selectively rotatable door and a basket with a rotatable flap that rotates with the rotatable door.

18 Claims, 10 Drawing Sheets

(56) References Cited

U.S. PATENT DOCUMENTS

| | | | | |
|---|---|---|---|---|
| 10,578,351 | B1 * | 3/2020 | Nuss | A47B 88/40 |
| 10,712,082 | B1 * | 7/2020 | Nuss | E05D 11/1007 |
| 10,731,917 | B1 * | 8/2020 | Nuss | F25D 23/028 |
| 11,317,717 | B1 * | 5/2022 | Nuss | A47B 88/40 |
| 2004/0100168 | A1 | 5/2004 | Choi | |
| 2004/0183415 | A1 | 9/2004 | Kim | |
| 2006/0042305 | A1 * | 3/2006 | Oh | F25D 25/025 62/407 |
| 2006/0049731 | A1 * | 3/2006 | Choi | A47B 88/49 312/330.1 |
| 2006/0213852 | A1 * | 9/2006 | Kwon | F25D 25/021 211/151 |
| 2007/0126325 | A1 * | 6/2007 | Gorz | F25D 25/025 312/404 |
| 2008/0244869 | A1 * | 10/2008 | Bae | F25D 23/028 16/412 |
| 2009/0193836 | A1 * | 8/2009 | Ertz | F25D 25/025 62/449 |
| 2010/0090575 | A1 * | 4/2010 | Uthuppan | F25D 23/04 312/404 |
| 2010/0101266 | A1 * | 4/2010 | Kang | F25D 23/021 62/449 |
| 2011/0006655 | A1 * | 1/2011 | Seo | A47B 88/45 312/402 |
| 2011/0016908 | A1 * | 1/2011 | Kim | F25D 25/025 62/449 |
| 2013/0119845 | A1 * | 5/2013 | Seo | F25D 23/04 312/405.1 |
| 2016/0209102 | A1 | 7/2016 | Vulava et al. | |
| 2018/0014638 | A1 | 1/2018 | Hanley et al. | |
| 2018/0223582 | A1 | 8/2018 | Shin et al. | |

FOREIGN PATENT DOCUMENTS

| | | | | |
|---|---|---|---|---|
| CN | 107763951 | A | | 3/2018 |
| CN | 108868422 | A | | 11/2018 |
| EP | 2754982 | A1 | | 7/2014 |
| JP | H051990 | U | | 1/1993 |
| JP | 2004191039 | A | | 7/2004 |
| JP | 2008309424 | A | * | 12/2008 |
| JP | 2017020718 | A | | 1/2017 |
| JP | 2017101891 | A | | 6/2017 |
| KR | 1020050057863 | A | | 6/2005 |
| WO | WO2011121834 | A1 | | 10/2011 |

* cited by examiner

SYNCHRONIZED BASKET FLAP

FIELD OF THE INVENTION

The present disclosure is related generally to refrigerator appliances and more particularly to refrigerator appliances which include a drawer with an articulating drawer front and basket insert.

BACKGROUND OF THE INVENTION

Refrigerator appliances generally include one or more chilled compartments, e.g., a fresh food compartment, a freezer compartment, or the like, to maintain foods at low temperatures (i.e., lower than ambient). The chilled compartment(s) of a refrigerator are typically accessible through an opening, with access provided by one or more doors connected by hinges to the rest of the appliance. Consumers generally prefer chilled compartments that facilitate easy access to, and visibility of, the contents.

Some refrigerator appliances include one or more rotatably mounted opposing doors for access to a single opening, e.g., the fresh food compartment. Some refrigerator appliances provide access to a chilled compartment via a pull-out drawer that can be manually moved into and out of the chilled compartment on suitable slide mechanisms. Drawers are typically provided with a basket to contain contents with five surfaces, generally a bottom and four sides. Access to the drawer is provided when the drawer is open through the top side.

However, access to the internal space of the drawer and basket is limited by the front side of the basket.

Accordingly, an improved drawer front and basket for use in refrigerator appliances that address one or more of the above-described challenges would be beneficial.

BRIEF DESCRIPTION OF THE INVENTION

The present subject matter is directed to a refrigerator appliance having at least a slidable drawer for access to the chilled compartment of the refrigerator appliance. In particular, the present disclosure provides a drawer with a front providing selectable tilting in order to provide improved access to the drawer. Additional aspects and advantages of the invention will be set forth in part in the following description, or may be apparent from the description, or may be learned through practice of the invention.

In one exemplary aspect, a refrigerator appliance comprising a cabinet defining a fresh food chamber and a frozen food chamber is provided. A drawer is slidably mounted within one of the chambers, the drawer having a drawer body defining an interior of the drawer. A door rotatably attached to the drawer body and selectively rotatable relative to the drawer body between a closed position where the door closes a front side of the drawer body and an open position to provide access to the interior of the drawer. A basket is fitted within the interior of the drawer, the basket comprising a basket body defining a storage area and a basket flap rotatably attached to the basket body and rotatable relative to the basket body between a first position where the basket flap closes a front side of the storage area and a second position to provide access to the storage area. The basket flap rotates from the first position to the second position when the door rotates from the closed position to the open position.

In another example aspect, a drawer for a refrigerator appliance is provided. The refrigerator appliance comprises a cabinet defining a fresh food storage chamber and a frozen food storage chamber, the drawer configured for slidably mounting within one of the fresh food storage chamber and the frozen food storage chamber. The drawer comprises a drawer body defining an interior of the drawer, a door rotatably attached to the drawer body whereby the door is selectively rotatable relative to the drawer body between a closed position where the door closes a front side of the drawer body and an open position to provide access to the interior of the drawer. A basket is fitted within the interior of the drawer, the basket comprising a basket body defining a storage area and a basket flap rotatably attached to the basket body and rotatable relative to the basket body between a first position where the basket flap closes a front side of the storage area and a second position to provide access to the storage area. The basket flap rotates from the first position to the second position when the door rotates from the closed position to the open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
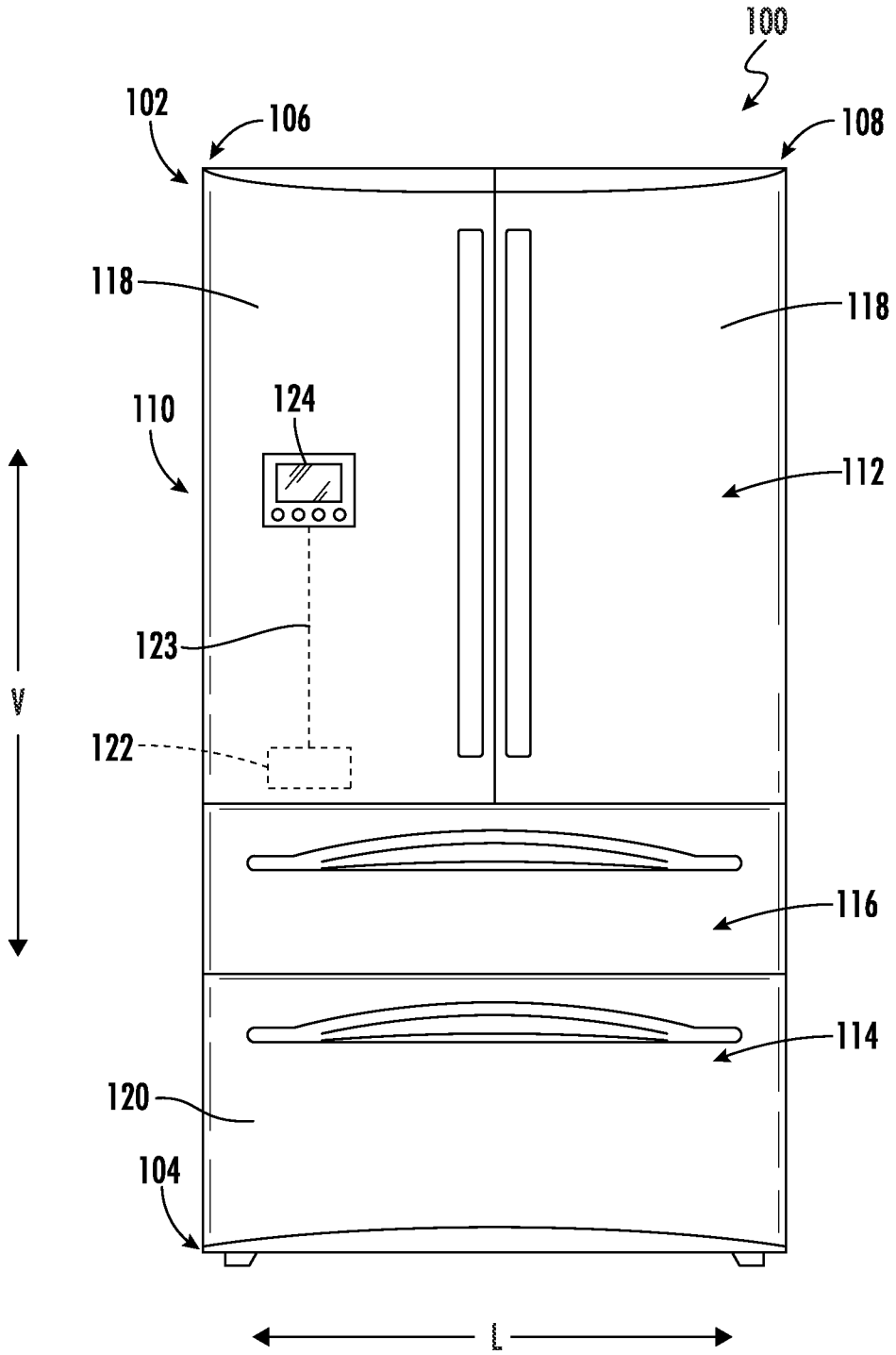
FIG. 1 provides a front view of a refrigerator appliance according to an exemplary embodiment of the present disclosure.

Reference now will be made in detail to embodiments of the invention, one or more examples of which are illustrated in the drawings. Each example is provided by way of explanation of the invention, not a limitation of the invention. It will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," "third," and "fourth" may be used to distinguish one component from another and are not intended to signify importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein. "Adjacent," as used herein, is intended to mean "lying near, close, or touching" in accordance with a generally accepted understanding of the word.

As used herein, "substantially" means within ten degrees (10°) of the noted direction or within about ten percent (10%) of the noted value or within manufacturing tolerances, whichever margin is greater, unless specifically stated otherwise.

FIG. 1 provides a front view of an exemplary refrigerator appliance 100 according to an exemplary embodiment of the present disclosure. Refrigerator appliance 100 extends between a top 102 and a bottom 104 along a vertical direction V. Refrigerator appliance 100 also extends between a first side 106 and a second side 108 along a lateral direction L. Further, refrigerator appliance 100 extends between a front portion 109 and a back portion 111 along a transverse direction T (FIG. 2), which is a direction orthogonal to the vertical direction V and the lateral direction L. Vertical direction V, lateral direction L, and transverse direction T are mutually perpendicular and form an orthogonal direction system.

Refrigerator appliance 100 includes a housing or cabinet 110 defining a fresh food chamber 112, a lower frozen food storage chamber 114 below the fresh food chamber 112 in the vertical direction V, and a drawer 116 which may provide access to a chilled chamber for fresh or frozen food storage located between the fresh food chamber 112 and the frozen food storage chamber 114. A freezer door 120 is positioned below refrigerator doors 118 for accessing frozen food storage chamber 114. In an exemplary embodiment, freezer door 120 is coupled to a freezer drawer (not shown) slidably coupled to cabinet 110 within the frozen food storage chamber 114.

Cabinet 110 also defines a mechanical compartment (not shown) for receipt of a sealed cooling system (not shown).

Refrigerator doors 118 are rotatably hinged to an edge of cabinet 110 for accessing fresh food chamber 112. For example, upper and lower hinges (not shown) may couple refrigerator doors 118 to cabinet 110. When refrigerator doors 118 are configured as illustrated in FIG. 1, the door arrangement is sometimes referred to as a "French door" configuration. Because the frozen food storage chamber 114 is positioned below the fresh food chamber 112, refrigerator appliance 100 is generally referred to as a bottom mount freezer refrigerator.

Using the teachings disclosed herein, one of skill in the art will understand that the present technology can be used with other types of refrigerators (e.g., side-by-side) or a freezer appliance as well that include drawers to provide access to the chilled compartment(s). Consequently, the description set forth herein is for illustrative purposes only and is not intended to limit the technology in any aspect.

Operation of the refrigerator appliance 100 can be regulated by a controller 122 that is operatively coupled to a user interface panel 124. Panel 124 provides selections for user manipulation of the operation of refrigerator appliance 100, for example temperature selections. In response to user manipulation of the user interface panel 124, the controller 122 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 122 may be positioned in a variety of locations throughout refrigerator appliance 100. In the illustrated embodiment, the controller 122 may be located within one of the doors 118. In such an embodiment, input/output ("I/O") signals may be routed between the controller and various operational components of refrigerator appliance 100. In one embodiment, the user interface panel 124 may represent a general purpose I/O ("GPIO") device or functional block. In one embodiment, the user interface panel 124 may include input components, such as one or more of a variety of electrical, mechanical, or electro-mechanical input devices including rotary dials, push buttons, and touch pads. The user interface panel 124 may include a display component, such as a digital or analog display device designed to provide operational feedback to a user. The user interface panel 124 may be in communication with the controller 122 via one or more signal lines or shared communication busses 123.

Figure 2:
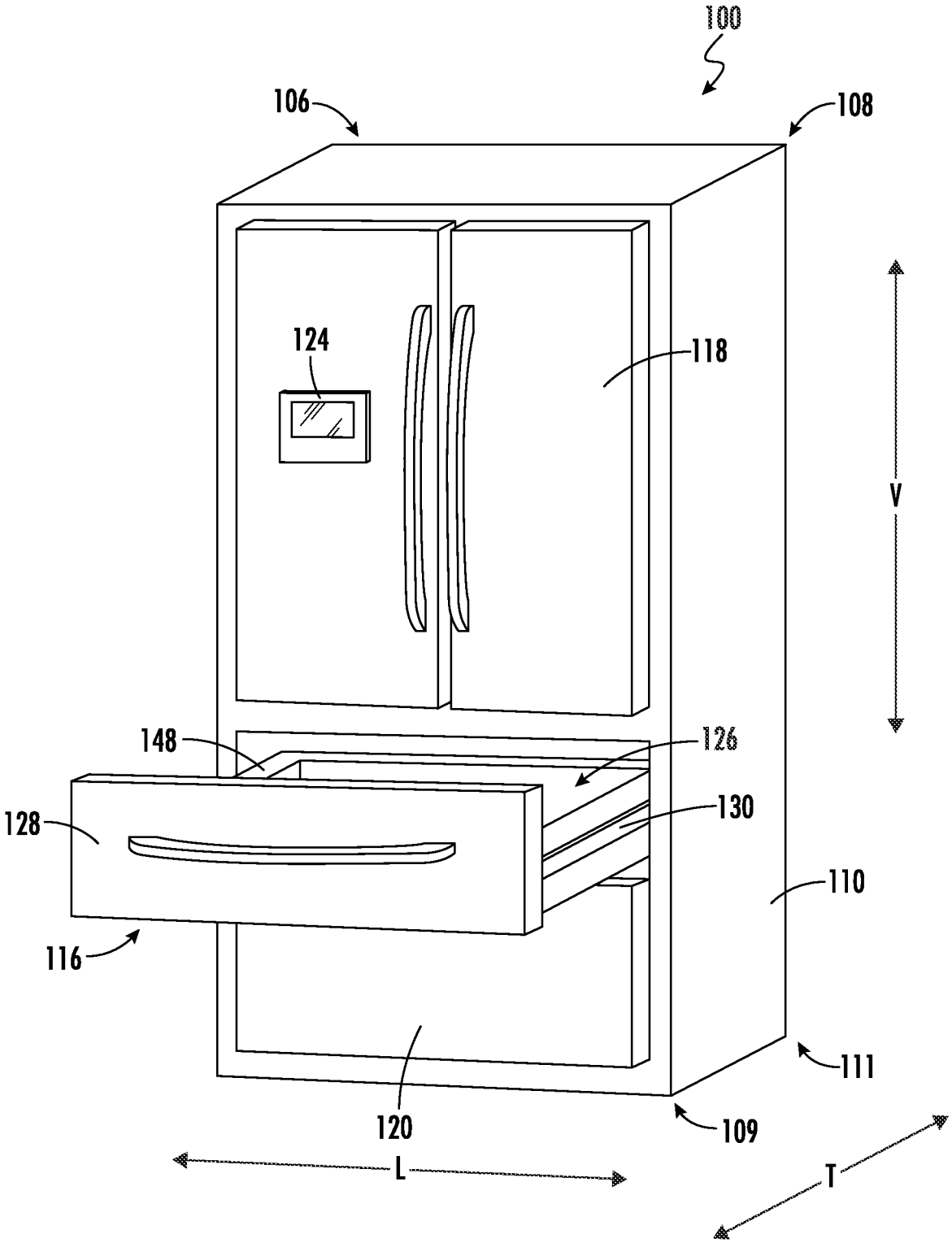
FIG. 2 provides a front perspective view of the refrigerator appliance of FIG. 1 with a drawer thereof in an extended position and a door of the drawer in a closed position.
Figure 3:
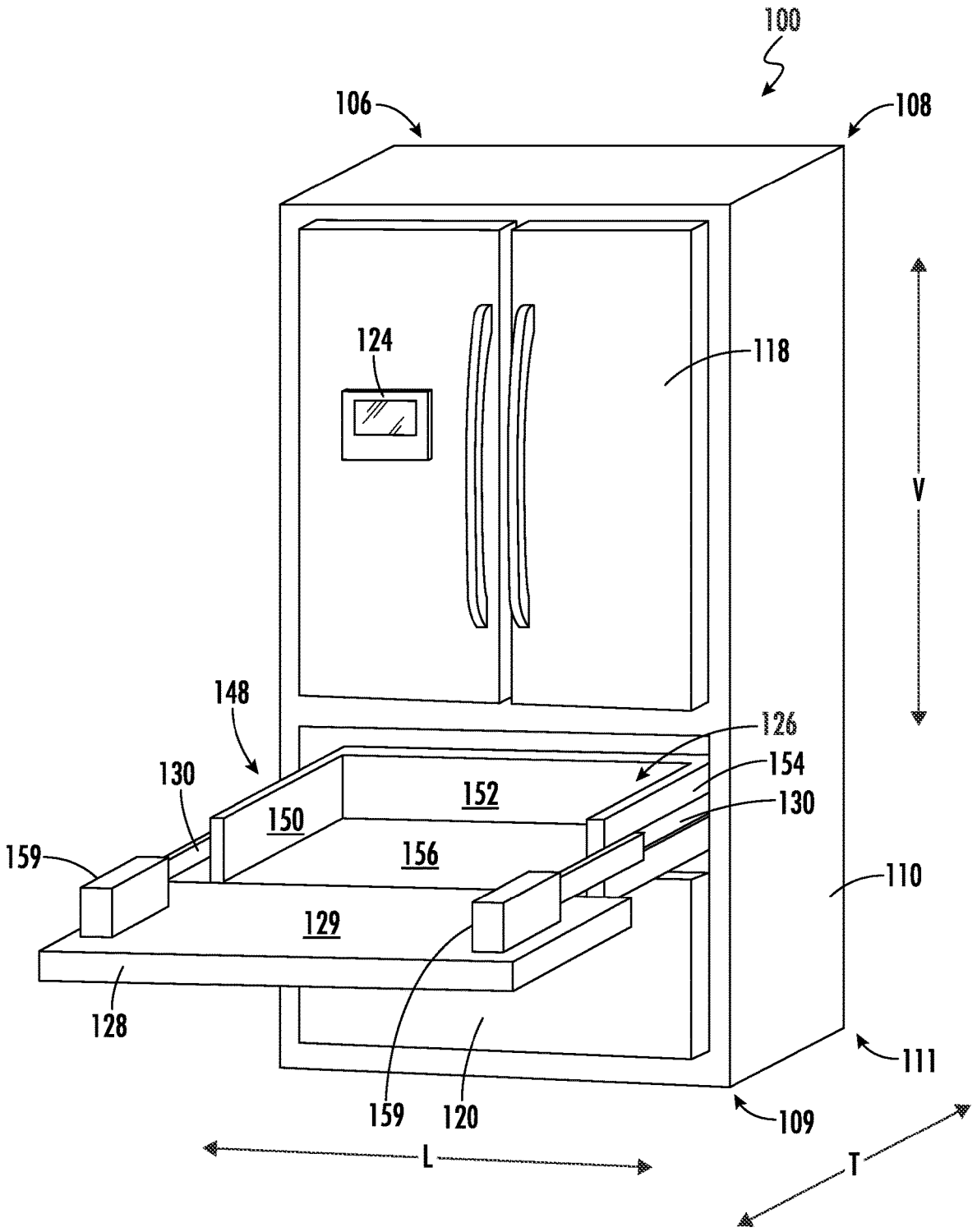
FIG. 3 provides perspective view of the refrigerator appliance of FIG. 2 with the door of the drawer in an open position.

FIG. 2 represents a perspective view of an exemplary refrigerator appliance 100 having a drawer 116 in an open position to reveal the interior 126 of the drawer 116. FIG. 3 represents a perspective view of the refrigerator appliance 100 having a door 128 of the drawer 116 in an open position to promote access to the interior 126 of the drawer 116.

FIGS. 2 and 3 are illustrative of one embodiment of a drawer 116 for the refrigerator appliance 100. The drawer 116 may be slidably mounted within the cabinet 110, for example with slides 130. The drawer 116 may be slidable between a retracted position (e.g., closed (FIG. 1)) when the door 128 of the drawer 116 is proximate to the cabinet 110 and an extended position (e.g., open (FIG. 2)) where the door 128 of the drawer 116 is spaced apart from the cabinet 110. Drawer 116 may include a drawer body 148 which includes a left wall 150, a back wall 152, a right wall 154, and a bottom wall 156. The drawer body 148 may at least partially define an interior 126 of the drawer 116. For example, in the illustrated embodiment, the interior 126 of the drawer 116 is collectively defined by the drawer body 148 and the door 128 in the closed position of FIG. 2 in which position the door closes the front side of the drawer body 148. The door 128 includes an inner surface 129 facing the interior 126 when the door 128 is in a closed position.

Figure 6:
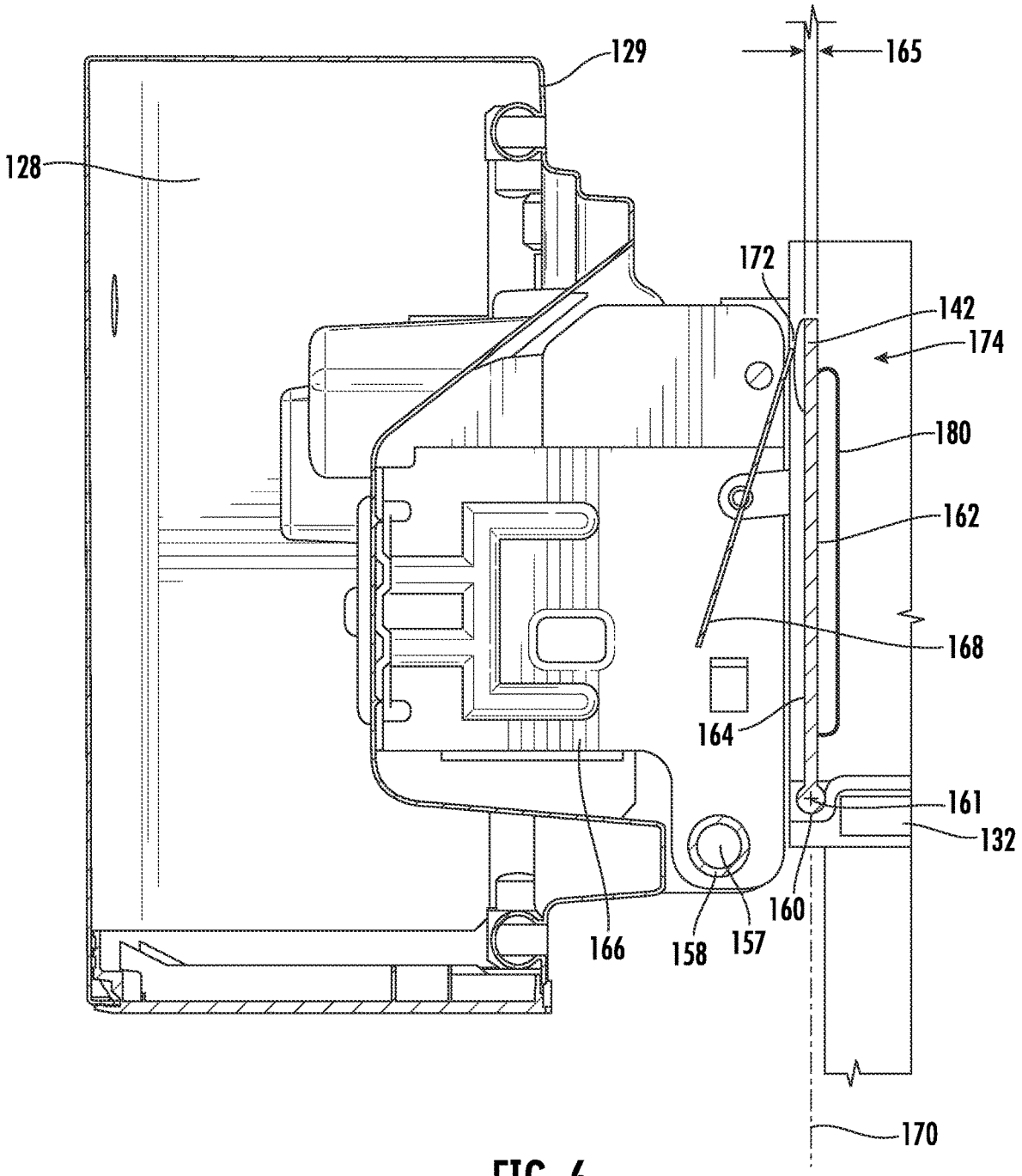
FIG. 6 represents a horizontal sectional view of the drawer and basket of FIG. 4 taken through the door and basket flap at VI-VI.

To promote accessibility to the interior 126, the door 128 of the drawer 116 may be selectively rotatably movable relative to the drawer body 148 to an open position as shown in FIG. 3. The door 128 may be selectively rotatable relative to the drawer body 148 in that the door 128 may be connected to the drawer body 148 by one or more door linkages 159 and one or more door pivots 158 (FIG. 6). Door 128 is selectively rotatable between the closed position (FIG. 2) and the open position (FIG. 3) in that linkages 159 may maintain the door 128 in the closed position until the drawer 116 is in a prescribed position, for example a fully extended position, at which point the door linkages 159 will support rotation of the door 128 to the open position. The linkages 159 may cooperate with the slides 130 to prevent the drawer 116 from retracting until the door 128 is returned to the closed position. In some embodiments, the position and operation of the linkages 159, the slides 130, or both the linkages 159 the slides 130 are managed by the controller 122.

Figure 4:
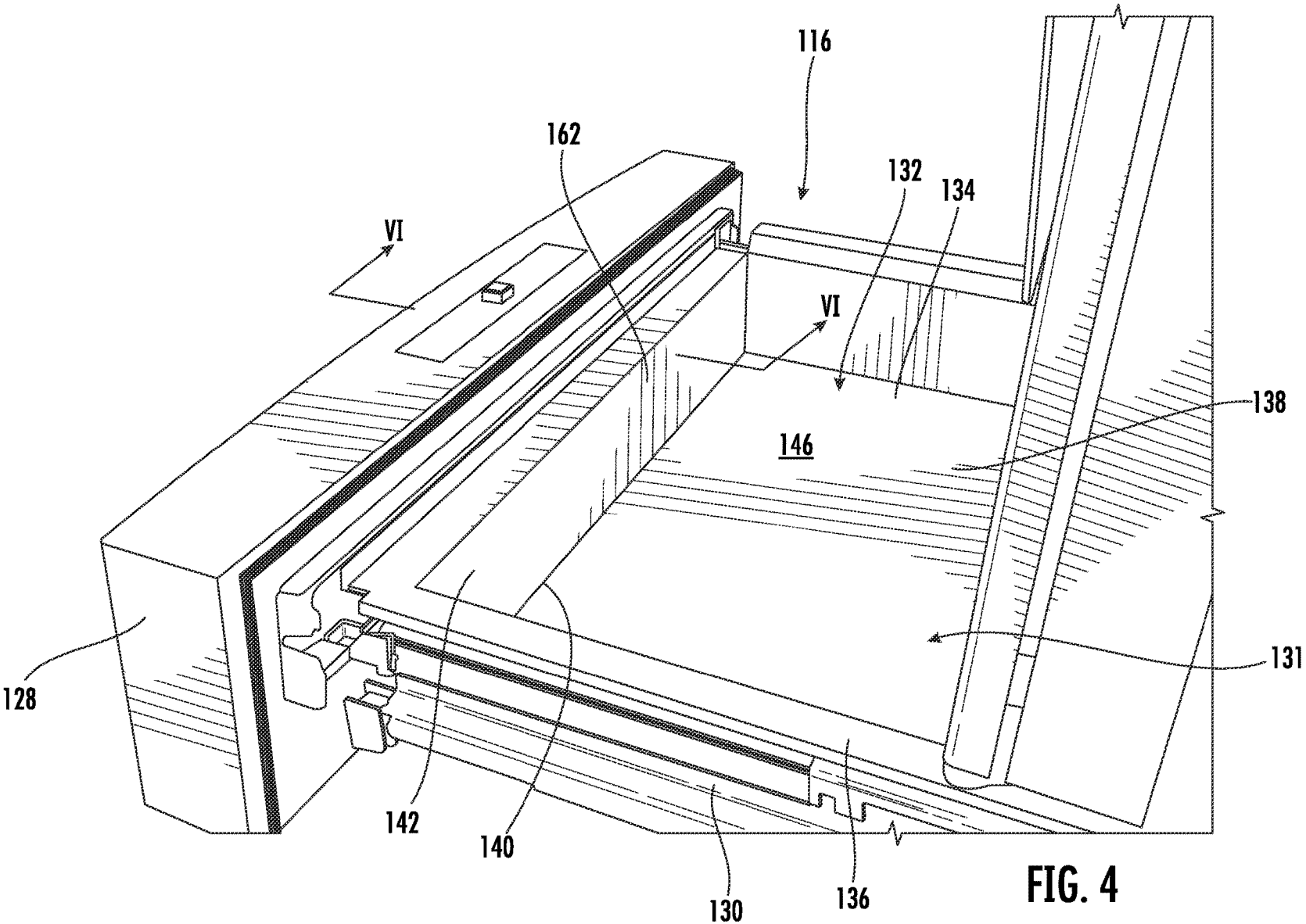
FIG. 4 provides side perspective view the refrigerator appliance of FIG. 2 with a drawer and basket and a door of the drawer in a closed position.
Figure 7:
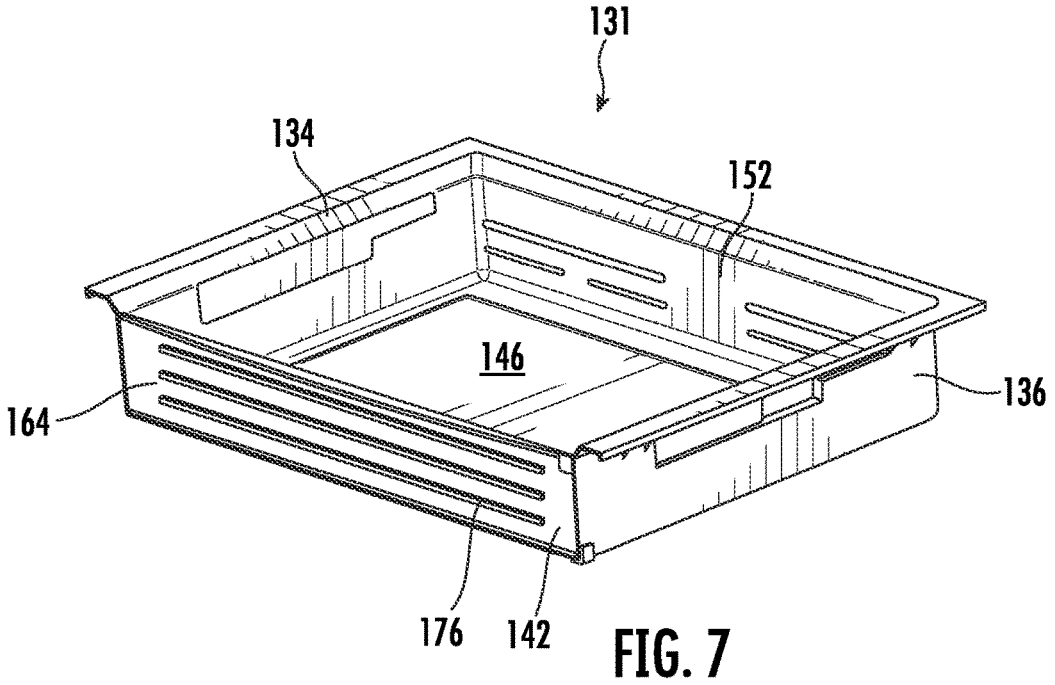
FIG. 7 represents a perspective view of a basket with a basket flap in a first position in accordance with an embodiment of this disclosure.
Figure 8:
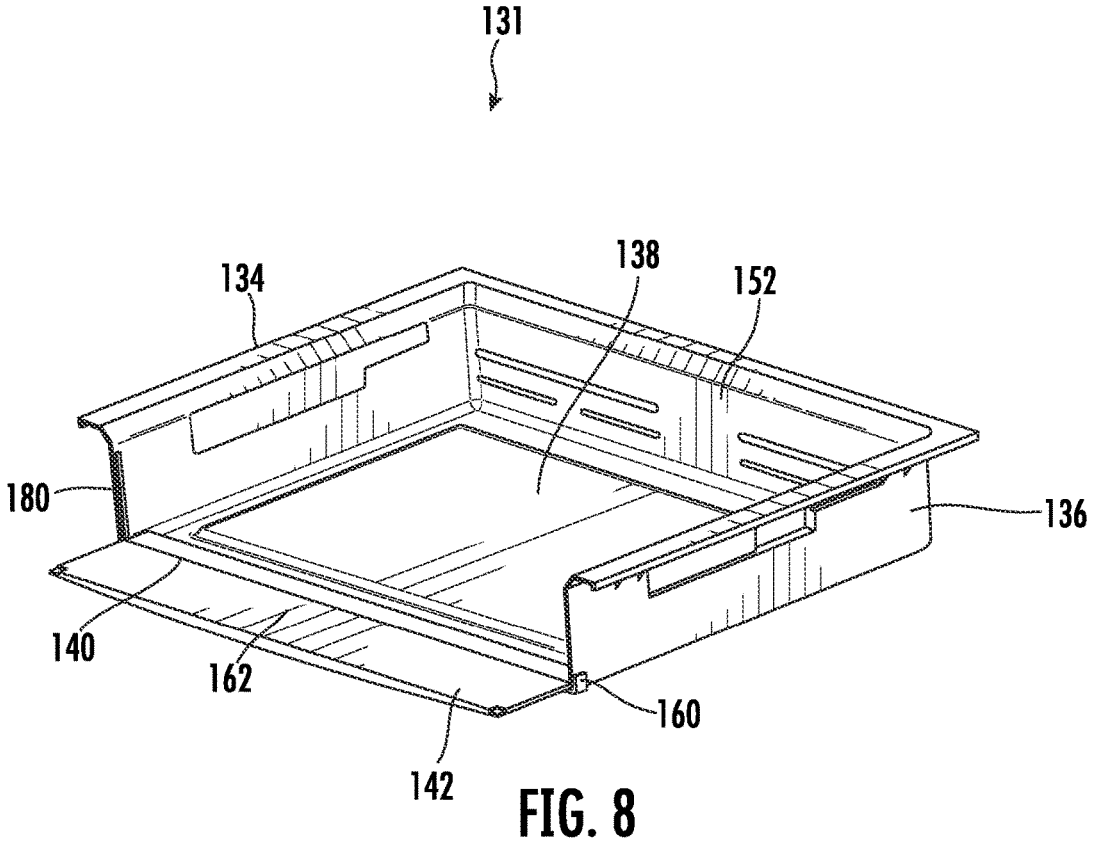
FIG. 8 represents a perspective of a basket of FIG. 7 with a basket flap in a second position in accordance with an embodiment of this disclosure.

FIG. 4 represents a perspective view of the drawer 116 in the extended position with the door 128 in the closed position and a basket 131 removably fitted in the interior 126 of drawer 116 with basket flap 142 in the first position. The basket 131 includes a basket body 132 which includes two side walls, left side wall 134 and right side wall 136, and back wall 152 (FIG. 5), each wall 134, 136 may be affixed to bottom 138 of basket body 132. Left and right side walls 134, 136 are generally parallel to each other and generally perpendicular to the bottom 138. Back wall 152 is generally perpendicular to left and right side walls 134, 136 and generally perpendicular to bottom 138. Back wall 152 may be affixed to left and right side walls 134, 136 and bottom 138. Basket flap 142 is pivotally attached to the basket body 132 at a front edge 140 of the bottom 138 of basket body 132, for example using pivot point 160 (FIG. 6). Basket flap 142 may be pivotally attached to the left and right side walls 134, 136, or pivotally attached to the bottom 138 at the front edge 140, or pivotally attached to the left and right side walls 134, 136 and the bottom 138. Basket flap 142 substantially extends between the left side wall 134 and right side wall 136. FIGS. 7 and 8 illustrate an embodiment of the basket 131 separate from the drawer 116 for clarity.

Figure 9:
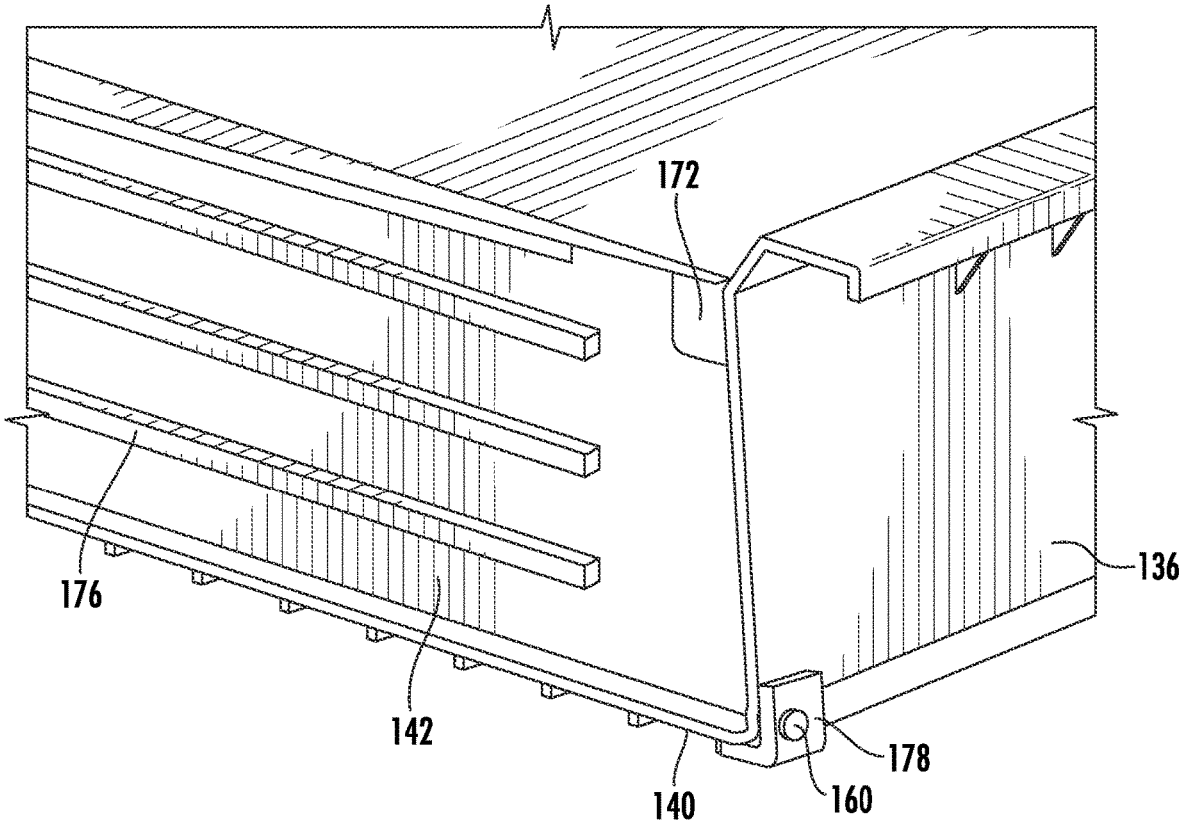
FIG. 9 represents an enlarged view of a basket flap attachment to a basket body.

In an exemplary embodiment illustrated in FIG. 9, basket flap 142 is attached to the basket body 132 through a pivotal attachment to the left and right side walls 134, 136 (right side wall 136 shown; left 134 side wall is similar). The right side wall 136 defines a receptacle 178 at the front edge 140 of the basket body 132. As illustrated, receptacle 178 is a through hole. In other embodiments, the receptacle 178 may be a blind hole formed in the left and right side walls 134, 136. The basket flap 142 includes flap pivot 160 received in the receptacle for rotational displacement about center point 161.

Figure 5:
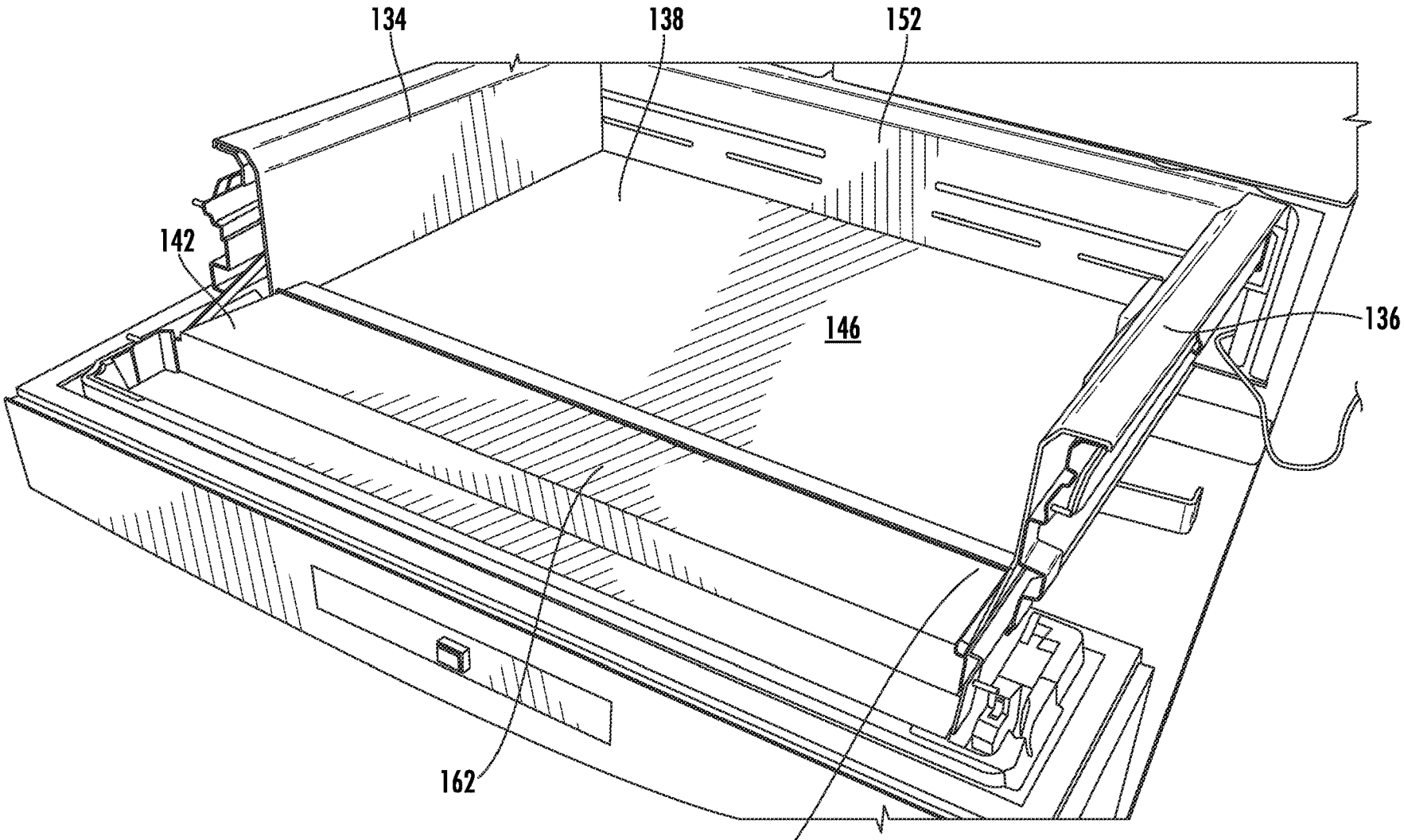
FIG. 5 provides front perspective view the refrigerator appliance of FIG. 2 with a draw, a basket, and a door of the drawer in an open position.

Basket flap 142 is rotatable between a closed, first position as illustrated in FIG. 4 and an open, second position as illustrated in FIG. 5. In the first position, basket flap 142 is generally perpendicular to the bottom 138 of basket body 132 and closes the front side of storage area 146. In an embodiment of FIG. 8, at least one of left and right side walls 134, 136 (left sidewall 134 shown; right side wall 136 is similar) includes a boss or stop 180 (FIG. 8) extending from the left side wall 134 into the storage area 146 proximate to the front edge 140 of the basket body 132. When basket flap 142 is in the first position, flap inner surface 162 may abut the stop 180 supporting the basket flap 142 against rotation into the storage area 146.

In the second position illustrated in FIG. 5, flap inner surface 162 is substantially parallel to the bottom 138 of basket body 132. In some embodiments, flap inner surface 162 is coplanar, or substantially coplanar, with the bottom 138 of basket body 132 when the basket flap 142 is in the second position (FIG. 5 and FIG. 8).

The basket body 132 may at least partially define a storage area 146 of the basket 131. For example, in the illustrated embodiment, the storage area 146 of the basket 131 is collectively defined by the basket body 132 and the basket flap 142 in the closed position of FIG. 4. To promote accessibility to the storage area 146, the basket flap 142 may be rotatably movable relative to the basket body 132 to an open position as shown in FIG. 5. The basket flap 142 may be rotatable relative to the basket body 132 in that the basket flap 142 may be connected to the basket body 132 by one or more flap pivot points, such as pivot 160. The basket flap 142 has an inner surface 162 facing the storage area 146 when in the closed, first position (FIG. 4) and an outer surface 164 opposite the inner surface 162. The basket flap 142 has a thickness 165 spanning the distance between the inner and outer surfaces 162, 164.

In an embodiment illustrated in FIG. 6, basket flap 142 thickness 165 is substantially symmetrical with the flap pivot 160. That is, the center point 161 of the flap pivot 160 is coplanar with the midplane 170 of the thickness 165 such that the midplane 170 is a plane of symmetry for the basket flap 142. Therefore, when the basket flap 142 is in the closed, first position, the midplane 170 is vertical and the basket flap 142 is in a balanced position with equal mass on the basket flap inner and outer surfaces 162, 164. As illustrated, an embodiment includes a contact pad, pad 172, formed on the basket flap outer surface 164 at the vertically upper portion 174 of the basket flap 142. Pad 172 is asymmetrical with the basket flap 142 i.e., the pad 172 disrupts the midplane 170 symmetry of basket flap 142. Pad 172 is an over center feature in that the pad 172 is offset from the centerline, midplane 170, of the basket flap 142, with the pad biased towards and protruding from the flap outer surface 164. The mass of pad 172 upsets the symmetry about the midplane 170, urging the basket flap 142 to rotate toward an open position.

Other over center features may be included on the basket flap 142 in addition to the pad 172. In an embodiment illustrated in FIG. 7, basket flap 142 includes projections or ribs 176 extending from the flap outer surface 164. Three ribs 176 running in the lateral direction L are shown; more or fewer ribs 176 may be used, as well as ribs in other orientations, for example ribs 176 could run in the vertical direction V. Ribs 176 disrupt the midplane symmetry of the basket flap 142, placing mass on the flap outer surface 164 that is not found on the flap inner surface 162. Ribs 176 may be solid, or hollow, or may have portions that are solid and portions that are hollow. Over center features of other configurations may also be used.

As the over center features, pad 172, ribs 176, or the like, are biased to the flap outer surface 164, the midplane symmetry of the basket flap 142 is disrupted. With the additional mass offset to the outer surface 164, basket flap 142 is urged to rotate from the first (closed) position to the second (open) position.

In embodiments, at least one door bracket 166 is affixed to the door inner surface 129 to support rotatable attachment of the door 128 to the drawer body 148. In the illustrated embodiment of FIG. 6, door bracket 166 defines a passage to accept a pivot pin 157 to provide a pivot point 158. In embodiments, door pivot point 158 accepts a door pivot pin 157 such that door 128 is rotatably affixed to drawer body 148 at a pivot point with the door pivot pin 157. Door pivot pin 157 extends along at least a portion of the lateral L width of the door 128 and engages the drawer body 148 in at least one engagement point to support the door 128 in rotation about the door pivot pin 157. In some embodiments, multiple door pivot pins 157 and multiple engagement points may be used along lateral width of the door 128.

In the illustrative embodiment, door bracket 166 includes a bearing surface 168. In other embodiments, a bracket may not be provided and the bearing surface 168 may be formed on the inner surface 126 of the door 128 or included in a bracket different than door bracket 166. As explained in more detail below, pad 172 and bearing surface 168 are urged to maintain contact throughout the rotation of door 128. Bearing surface 168 may support pad 172 on basket flap 142 when door 128 is pivoted from the closed, first position toward the second, open position, and in the fully open position of FIGS. 3 and 5.

In the embodiments illustrated, interior 126 of drawer 116 receives basket 131 with left and right side walls 134, 136 adjacent to left and right walls 150, 154 and flap outer surface 164 adjacent to door inner surface 129. In some embodiments, basket 131 is removably received in the interior 126. In other embodiments, the basket 131 is permanently received in the interior 126. As illustrated in FIG. 6, with the door 128 in the closed position and the basket flap 142 in the first position, bearing surface 168 is positioned to contact pad 172 and support basket flap 142 against rotation away from the storage area 146.

Door 128 can be selectively rotated from the closed position (FIGS. 4 and 6) to the open position (FIG. 5), rotating about door pivot 158. As illustrated in FIG. 6, door pivot 158 and flap pivot 160 are offset from each other. In the illustrated embodiment, door pivot 158 is below the flap pivot 160 in the vertical direction V and offset in the transverse direction. As the door 128 rotates away from the basket 131, bearing surface 168 is displaced away from the pad 172 on basket flap 142.

Because door pivot 158 and flap pivot 160 are fixed and offset from each other, points on the door 128 and basket flap 142 follow different arcs. This results in relative sliding motion between the bearing surface 168 and the pad 172. For example, the portion of the pad 172 in contact with the bearing surface 168 when the door 128 is in the closed position (FIG. 6), is not that same portion that is in contact with bearing surface 168 when the door is in the open position of FIG. 11. Similarly, the portion of the bearing surface 168 that is in contact with the pad 172 when the door 128 is in the closed position (FIG. 6), is not that same portion that is in contact with pad 172 when the door is in the open position of FIG. 11. During the rotation of the door 128 from closed (FIG. 6) to open (FIG. 11) positions, the pad 172 slides along the bearing surface 168 and maintains contact with the bearing surface.

Figure 10:
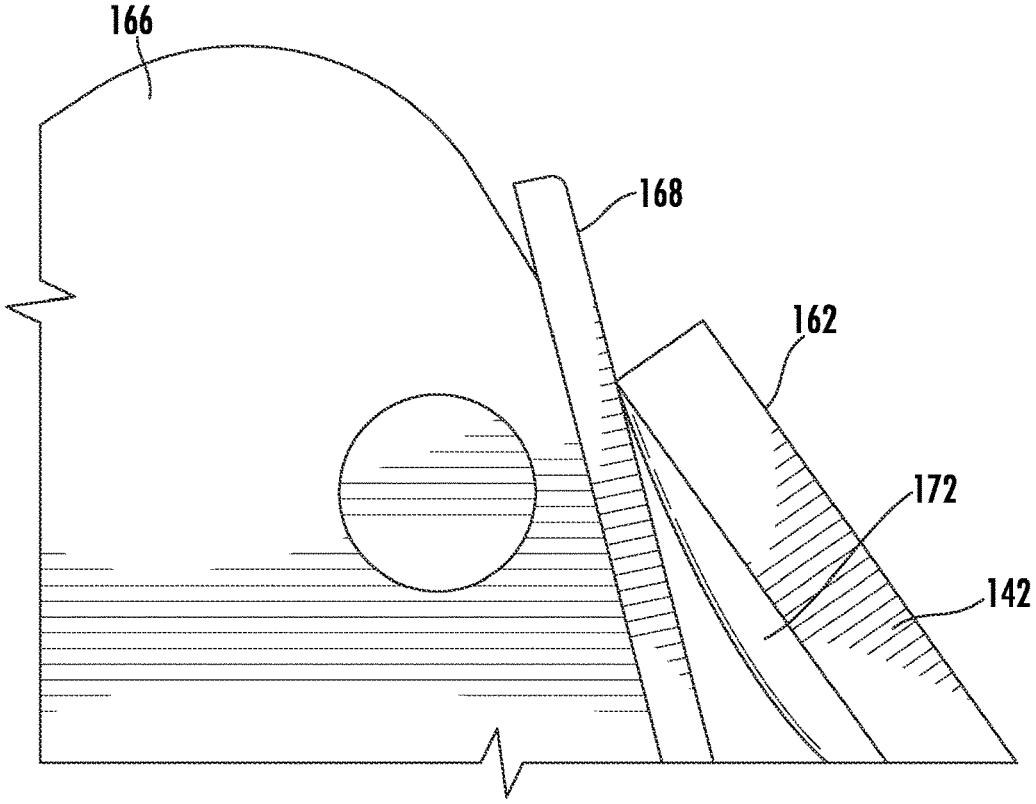
FIG. 10 represents an enlarged view of a bearing surface and pad with a door in a partially rotated position.
Figure 11:
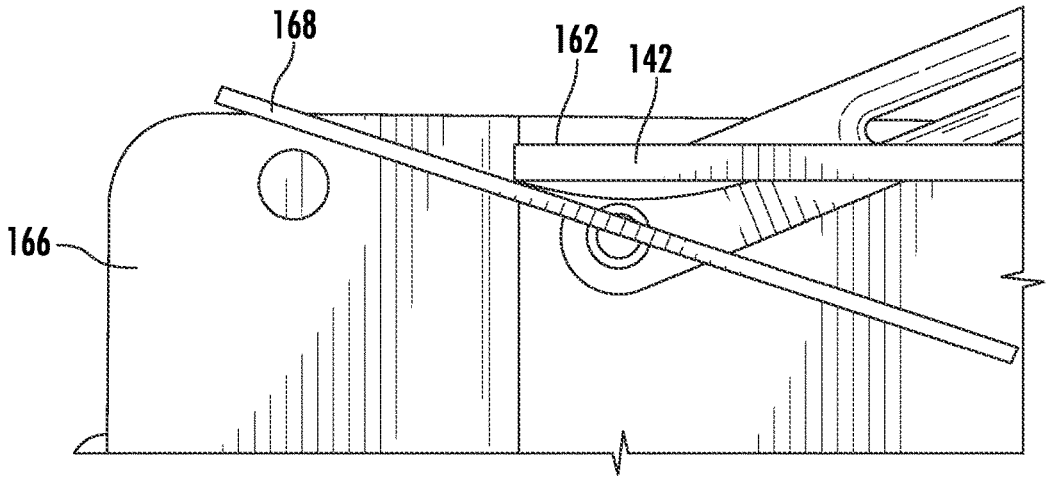
FIG. 11 represents an enlarged view of a bearing surface and pad with the door in an open position.

In embodiments, the over center location of the pad 172, or both the pad 172 and ribs 176, urge the basket flap 142 to rotate with the door 128 and maintain contact while allowing sliding motion. Contact and support is maintained between the pad 172 and the bearing surface 168 throughout rotation. FIGS. 10 and 11 represent enlarge view of the contact area between the bearing surface 168 and the pad 172 at an intermediate rotational position and at the open position for the door 128 and the second position for the basket flap 142, respectively.

FIG. 10 represents an intermediate position after selective rotation of the door 128 is initiated. As door bracket 166 rotates with the door 128 about the door pivot 158, basket flap 142 rotates about flap pivot 160. Contact between the bearing surface 168 and the pad 172 is maintained under the influence of the over center pad 172, or pad 172 and ribs 176, allowing linear translation of the pad 172 along the bearing surface 168. Contact is maintained throughout the range of rotation, i.e., from the closed position (FIG. 6) until the door 128 reaches the open position and basket flap reaches the second position as illustrated in FIG. 11. In the second position, door flap inner surface 162 is substantially horizontal (parallel to the L-T plane) and coplanar with the bottom 138 of the basket 131 with the pad 172 supported by the bearing surface 168.

Figure 12:
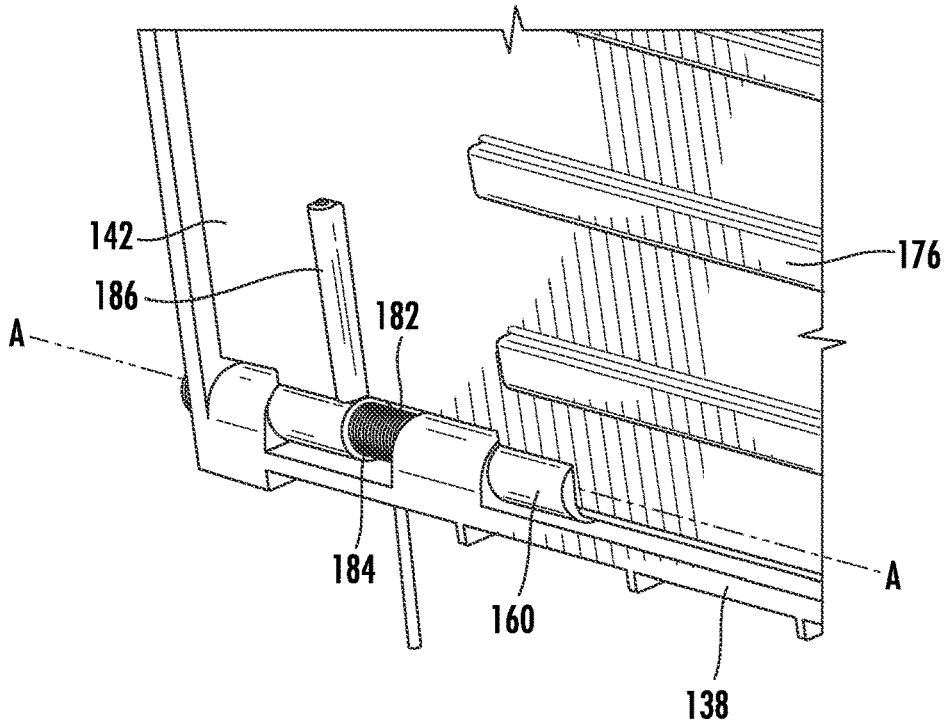
FIG. 12 represents an enlarged view of a flap pivot in accordance with an embodiment of the disclosure.
Figure 13:
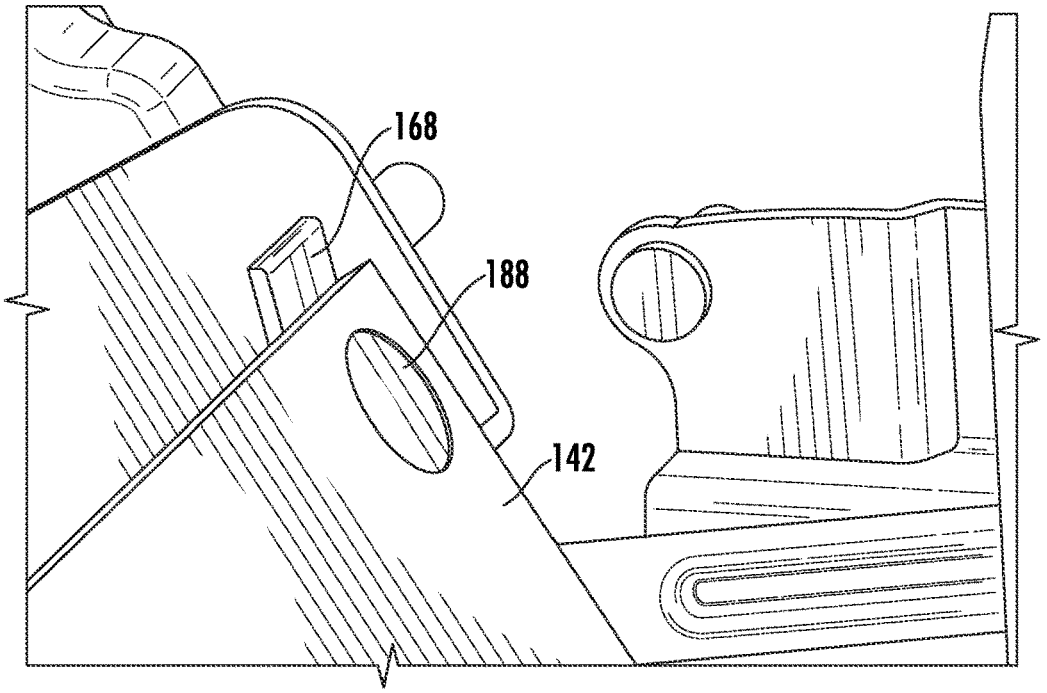
FIG. 13 represents an enlarge view of a basket flap and bearing surface in accordance with an embodiment of the disclosure.

In some embodiments, the pad on the basket flap 142 may be urged to contact the bearing surface with additional means, such as springs or magnets. As illustrated in FIG. 12, a torsion spring 182 may be provided positioned with the barrel 184 of the torsion spring 182 coaxial with the flap pivot 160 along axis A-A. One leg 186 of the torsion spring 182 is affixed to the basket flap 142 the basket body 132 and the other leg 186 to an independent element of the basket 131, for example the bottom 138 with the spring under a torsional load. The torsion spring will provide a torsional force about the A-A axis urging the pad 172 against the bearing surface 168.

Alternately or additionally, a magnet 188 may be provided in the basket flap 142. The magnet 188 may be mounted in or on the pad 172 to provide an attractive force when adjacent to a magnetic material, such as bearing surface 168 if made of a magnetic material.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a fresh food storage chamber and a frozen food storage chamber;

a drawer slidably mounted within one of the fresh food storage chamber and the frozen food storage chamber, the drawer comprising:

a drawer body defining an interior of the drawer;

a door rotatably attached to the drawer body whereby the door is selectively rotatable relative to the drawer body between a closed position where the door closes a front side of the drawer body and an open position to provide access to the interior of the drawer;

a basket fitted within the interior of the drawer, the basket comprising:

a basket body defining a storage area; and a basket flap rotatably attached to the basket body and rotatable relative to the basket body between a first position where the basket flap closes a front side of the storage area and a second position to provide access to the storage area;

wherein the basket flap rotates from the first position to the second position when the door rotates from the closed position to the open position.

2. The refrigerator appliance of claim 1, wherein the basket body comprises a bottom and the basket flap comprises an inner surface, wherein the inner surface of the basket flap is substantially perpendicular to the bottom when the basket flap is in the first position and generally parallel to the bottom when the basket flap is in the second position.

3. The refrigerator appliance of claim 2, wherein the inner surface of the basket flap is coplanar with the bottom when the basket flap is in the second position.

4. The refrigerator appliance of claim 2, wherein the basket body further comprises two side walls affixed to the bottom, wherein an inner surface of at least one of the side walls includes a stop extending into the storage area of the basket body, wherein the inner surface of the basket flap abuts the stop when the basket flap is in the first position.

5. The refrigerator appliance of claim 1, wherein the door comprises an inner surface including a bearing surface and an outer surface of the basket flap comprises a pad, wherein the bearing surface supports the pad in the first position when the door is in the closed position.

6. The refrigerator appliance of claim 1, wherein the door comprises an inner surface including a bearing surface and an outer surface of the basket flap comprises a pad, wherein the bearing surface supports the pad when the door selectively rotates from the closed position to the open position.

7. The refrigerator appliance of claim 6, wherein the pad is urged against the bearing surface during rotation from the closed position to the open position by an over center rib.

8. The refrigerator appliance of claim 6, wherein the pad is urged against the bearing surface during rotation from the closed position to the open position by a spring.

9. The refrigerator appliance of claim 6, wherein the bearing surface supports the pad for translation along the bearing surface.

10. A drawer for a refrigerator appliance, the refrigerator appliance comprising a cabinet defining a fresh food storage chamber and a frozen food storage chamber, the drawer configured for slidably mounting within one of the fresh food storage chamber and the frozen food storage chamber, the drawer comprising:

a drawer body defining an interior of the drawer;

a door rotatably attached to the drawer body whereby the door is selectively rotatable relative to the drawer body between a closed position where the door closes a front side of the drawer body and an open position to provide access to the interior of the drawer;

a basket fitted within the interior of the drawer, the basket comprising:

a basket body defining a storage area; and a basket flap rotatably attached to the basket body and rotatable relative to the basket body between a first position where the basket flap closes a front side of the storage area and a second position to provide access to the storage area;

wherein the basket flap rotates from the first position to the second position when the door rotates from the closed position to the open position.

11. The drawer of claim 10, wherein the basket body comprises a bottom and the basket flap comprises an inner surface, wherein the inner surface of the basket flap is generally perpendicular to the bottom when the basket flap is in the first position and generally parallel to the bottom when the basket flap is in the second position.

12. The drawer of claim 11, wherein the inner surface of the basket flap is coplanar with the bottom when the basket flap is in the second position.

13. The drawer of claim 11, wherein the basket body further comprises two side walls affixed to the bottom, wherein an inner surface of at least one of the side walls include a stop extending into the storage area of the basket body, wherein the inner surface of the basket flap abuts the stop when the basket flap is in the first position.

14. The drawer of claim 10, wherein the door comprises an inner surface including a bearing surface and an outer surface of the basket flap comprises a pad, wherein the bearing surface supports the pad in the first position when the door is in the closed position.

15. The drawer of claim 10, wherein the door comprises an inner surface including a bearing surface and an outer surface of the basket flap comprises a pad, wherein the bearing surface supports the pad when the door selectively rotates from the closed position to the open position.

16. The drawer of claim 15, wherein the pad is urged against the bearing surface during rotation from the closed position to the open position by an over center rib.

17. The drawer of claim 15, wherein the pad is urged against the bearing surface during rotation from the closed position to the open position by a spring.

18. The drawer of claim 15, wherein the bearing surface supports the pad for translation along the bearing surface.

* * * * *